US005346393A

United States Patent [19]

D'Souza

[11] Patent Number: 5,346,393

[45] Date of Patent: Sep. 13, 1994

[54] MULTIPLE-BED THERMAL OXIDIZER CONTROL DAMPER SYSTEM

[75] Inventor: Melanius D'Souza, San Dimas, Calif.

[73] Assignee: Smith Engineering Company, Ontario, Calif.

[21] Appl. No.: 12,354

[22] Filed: Feb. 2, 1993

[51] Int. Cl.[5] ..... F27D 17/00

[52] U.S. Cl. ..... 432/179; 432/180; 432/181; 110/211

[58] Field of Search ..... 432/179, 180, 181; 110/211

[56] References Cited

U.S. PATENT DOCUMENTS

| | | | |
|---|---|---|---|
| 483,752 | 10/1892 | Wainwright . | |
| 778,778 | 12/1904 | Glasgow . | |
| 1,354,747 | 10/1920 | Hiller . | |
| 1,503,464 | 8/1924 | Amsler . | |
| 1,538,686 | 5/1925 | Chamberlain . | |
| 1,558,157 | 10/1925 | Forster . | |
| 2,011,117 | 8/1935 | Richter | 98/33 |
| 2,910,284 | 10/1959 | Wittler | 263/15 |
| 3,664,706 | 5/1972 | Chant | 298/1 H |
| 3,870,474 | 3/1975 | Houston | 432/181 |
| 5,026,277 | 6/1991 | York | 432/181 |
| 5,098,286 | 3/1992 | York | 432/181 |
| 5,101,741 | 4/1992 | Gross | 110/233 |
| 5,129,332 | 7/1992 | Greco | 110/233 |
| 5,134,945 | 8/1992 | Reimlinger et al. | 165/4 |

*Primary Examiner*—Henry C. Yuen
*Attorney, Agent, or Firm*—Christie, Parker & Hale

[57] ABSTRACT

A damper system for three bed thermal regenerative oxidizers is disclosed, which employs two blades pivotally mounted in a body having two chambers separated by a septum. The first chamber receives an inlet gas through a first aperture and has a second aperture providing a flow path to a first regenerator bed. The second chamber incorporates a third aperture communicating with a second regenerator and a fourth aperture communicating with a third regenerator. The septum intermediate the first and second chambers incorporates a fifth aperture for communication between the chambers. Positioning of the first damper blade to seal the fifth aperture allows flow from the inlet to the first regenerator bed. Repositioning of the first blade to a second position covering the second aperture allows flow from the inlet through the aperture in the septum into the second chamber and through the third aperture to the second regenerative bed. Repositioning of the second blade from its first position sealing the fourth aperture to a second position sealing the third aperture allows flow from the second chamber into the third regenerator bed. Flow control is accomplished to three separate regenerator beds, employing only two damper blades enclosed in a common damper module which is easily mountable for inlet, exhaust and purge control in an oxidizer system.

6 Claims, 3 Drawing Sheets

MULTIPLE-BED THERMAL OXIDIZER CONTROL DAMPER SYSTEM

BACKGROUND OF THE INVENTION

1. Field of the Invention

The present invention relates generally to regenerative thermal oxidizer systems for waste gases containing volatile hydrocarbons. More particularly, the invention relates to flow-control dampers for routing of process and purge gas flow through inlet, outlet and idle regenerators.

2. Description of the Prior Art

Regenerative thermal oxidizer systems for pollution reduction employ control of the process gas flow path through multiple regenerative beds to increase efficiency in oxidizing the volatile hydrocarbon contaminants present in the process gas, while reducing the overall requirement for additional fuel input to raise gas temperature to create oxidation. Gas flowing from the process is routed through a first regenerator bed which heats the gas prior to entering a combustion chamber. Complete oxidation of the gas occurs in the combustion chamber and the purified gas is then routed through a second regenerator bed which cools the gas and heats the regenerator bed prior to exhausting of the gas to the atmosphere. Reversal of the process by providing the inlet process gas to the regenerator which has been heated by the purified outlet gas allows effective use of the reclaimed heat energy. Typical regenerator systems operate with three or more regenerator beds allowing an idle regenerator which has previously been used as an inlet for the process gas to be purged of any remaining contaminants in the bed prior to reversing flow through the bed for use as an outlet regenerator. Numerous configurations for such systems are disclosed in the prior art. However, exemplary systems in which the present invention may be employed are disclosed in U.S. Pat. Nos. 5,098,286 and 5,026,277, entitled Regenerative Thermal Incinerator Apparatus having a common assignee with the present application.

Control dampers for thermal regenerative systems, such as the prior art described, typically employ a single butterfly or gate arrangement on each individual inlet and outlet duct connected to the regenerators in the oxidizer system. Such systems typically require six dampers for the inlet and outlet ducts of a three regenerator system with an additional three dampers located in purge ducts connected to the regenerators. Each damper requires individual control and meeting the requirements of the process flow entails coordination of operation of all valves individually to avoid flow disruption.

It is therefore desirable to reduce the number of control elements required in the flow control system and the number of dampers to reduce the number of moving parts required in a high thermal stress environment.

SUMMARY OF THE INVENTION

The present invention incorporates a damper configuration having two blades pivotally mounted in a body having two chambers. The first chamber receives an inlet gas stream through a first aperture and has a second aperture providing a flow path to a first regenerator bed. The second chamber incorporates a third aperture for communication to a second regenerator bed and a fourth aperture for connection to a third regenerator bed. A septum extends intermediate the first and second chambers and incorporates a fifth aperture for communication between the chambers. The first damper blade is pivotally mounted for rotation from a first position covering and sealing the fifth aperture present in the septum to a second position covering and sealing the second aperture present in the first chamber. This directs the inlet flow entering the damper through the first aperture to the second chamber. The second damper blade is pivotally mounted for rotation from a first position covering and sealing the fourth aperture to a second position covering and sealing the third aperture thereby allowing selection of flow to the second or third regenerator bed respectively.

A complete regenerator flow system is created by employing a second damper having a configuration identical to the first damper with reversed flow wherein the purified gas arriving from regenerators 1, 2 or 3 is received into the body of the valve and exits through the first aperture in the body for connection to the external flow path for exhaust to the atmosphere. A third damper of identical configuration is also incorporated to provide negative pressure purging of the idle regenerator in the system. Arrangement of the damper blades allows purge gas flow from the first, second or third regenerator through the second, third or fourth aperture respectively, to be withdrawn from the damper under negative pressure induced flow through the first aperture of the damper.

A regenerative thermal oxidizer flow control system employing the present invention and comprising three damper systems as described eliminates three damper blades or valves and their associated actuation hardware and control requirements from a conventional control system wherein individual dampers are provided for inlet, outlet and purge of each of the regenerator beds. In addition, the configuration of the present invention precludes flow interruption in the inlet or outlet of the system. Positioning of the damper blades in each system automatically provides flow access to one regenerator bed and transition between positions of the blades is accomplished without the potential for flow interruption.

DETAILED DESCRIPTION OF THE INVENTION

Figure 1:
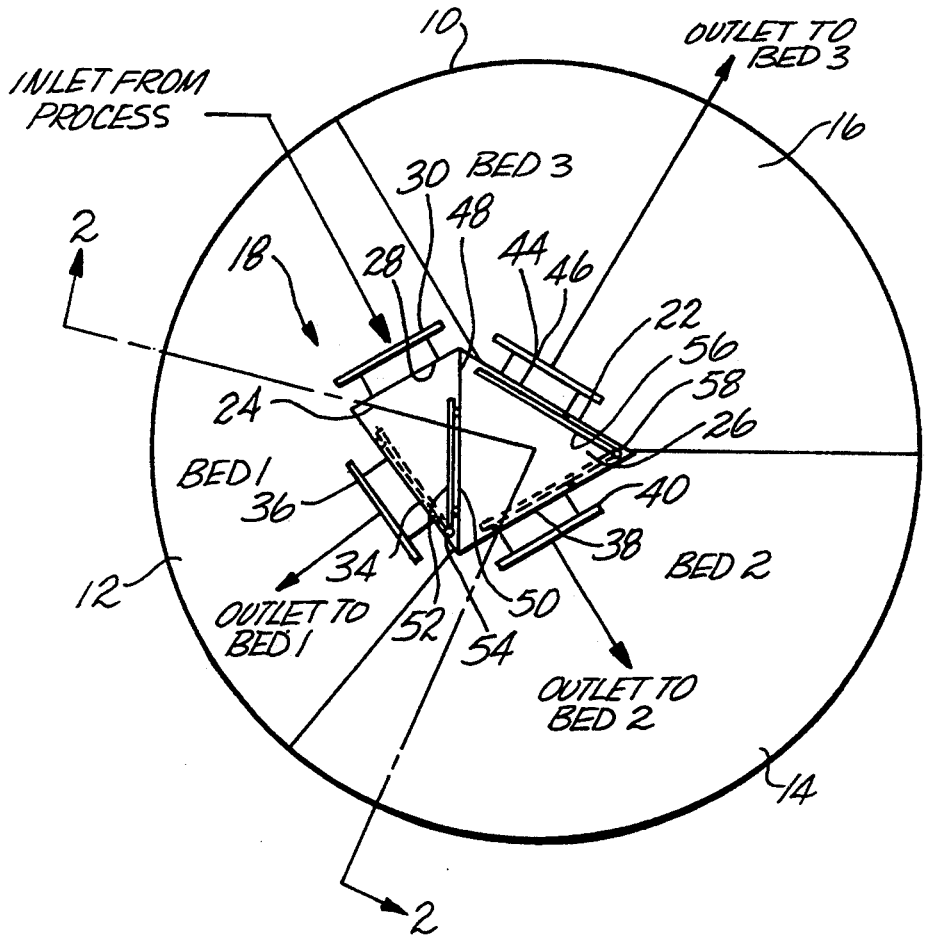
FIG. 1 is a bottom view of a first embodiment of the invention employing a three-bed regenerator within a single cylinder.

Referring to the drawings, FIG. 1 shows a first embodiment of the present invention incorporated in a thermal regenerative oxidizer having a single canister 10 segmented into three regenerator beds 12, 14, and 16, respectively. Referring to the partial cut-away elevation view of the invention shown in FIG. 2, three damper subsystems are shown; an inlet damper sub-system 18, an exhaust damper sub-system 20 and a purge damper sub-system 21. As best seen in FIG. 1, using the inlet damper sub-system as exemplary, each damper sub-system employs a body 22 having a first chamber 24 and a second chamber 26. The first chamber has a first aperture 28 with an appropriate flange attachment 30 to receive inlet process gas from inlet conduit 32 (best seen in FIG. 2). A second aperture 34 provides a first outlet flow path for the process gas through a second flange arrangement 36 attached to regenerator inlet ducting (not shown) to carry the flow to the first regenerator bed 12. The second chamber contains a third aperture 38 with a connecting flange 40 for interfacing to regenerator inlet ducting 42 (best seen in FIG 2.) connecting to the second regenerator bed 14 and a fourth aperture 44 with attachment flange 46 connecting to inlet ducting to the third regenerator bed 16.

A septum 48 separates the two chambers, and a fifth aperture 50 in the septum is closed by a first damper blade 52 mounted at a pivot 54 at a vertex formed by the interconnection of the septum with a wall of the first chamber carrying the second aperture. This first position of the damper seals the aperture in the septum creating a flow path from the inlet carrying process gas through the first aperture into the first chamber and out through the second aperture into the first regenerator bed. The first damper blade is pivotally movable to a second position (shown in phantom in FIG. 1) covering the second aperture thereby causing inlet gas to flow from the inlet through the first chamber and into the second chamber. A second damper blade 56 is mounted on a pivot 58 located at a vertex of the walls of the body carrying the third and fourth apertures. In a first position, the second damper blade closes and seals the fourth aperture and inlet flow entering the second chamber through the aperture in the septum exits the second chamber through the third aperture thereby flowing to the second regenerator bed. Pivoting of the second damper blade to a second position closing and sealing the third aperture (shown in phantom in FIG. 1) forces process gas flow from the second chamber through the fourth aperture into the third regenerator bed. Inlet process gas flow is controlled using the two damper blades for directing the flow to the first, second or third regenerator bed as desired.

Rotation of the damper blades is accomplished in the embodiment of the invention shown in the drawings through standard hydraulic, pneumatic, or electric motor control. Direct rotational shaft input to the pivoting axle holding the blade provides a first embodiment for actuation while mounting of a linear actuator with attachment to a lever arm mounted perpendicular to the pivot axle provides a second embodiment operable with the invention. Those skilled in the art will recognize that multiple cam and follower arrangements are applicable for single motor drive of the six damper blades present in the three damper sub-systems.

Figure 2:
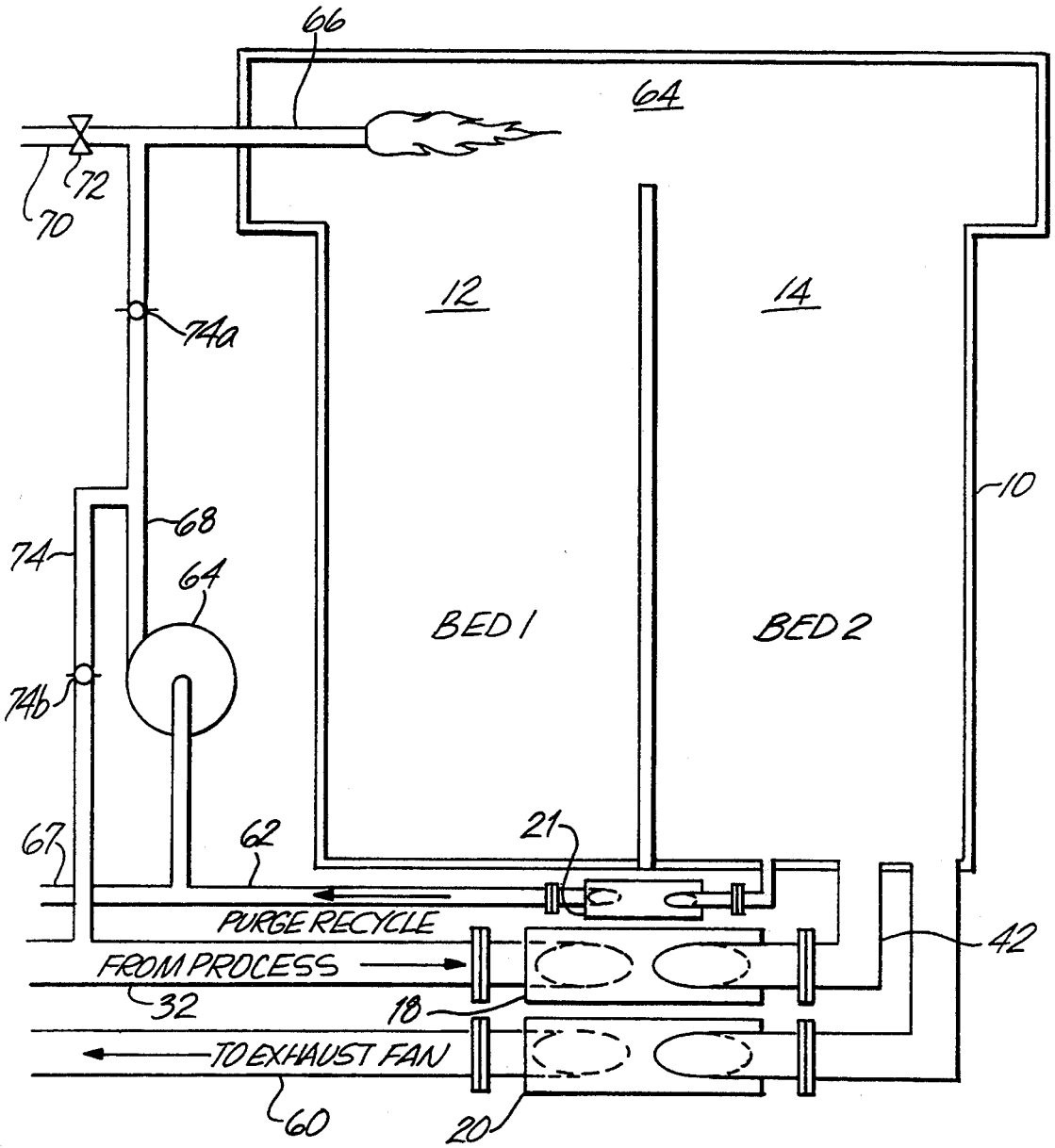
FIG. 2 is a schematic representation of the flow system of the present invention incorporating process gas inlet, exhaust gas outlet and purged recycled gas system with purge fan and oxidation chamber fuel air supply system shown in section view along lines 22 of FIG. 1.

A thermal regenerator control system employing the invention as shown in FIG. 2 incorporates an exhaust damper sub-system 20 identical in physical arrangement to the inlet damper sub-system previously described. The flow path through the exhaust damper sub-system is reversed from that described for the inlet damper sub-system with flow arriving from the first regenerator bed through the second aperture and into the first chamber or from the second or third regenerator bed through the third or fourth aperture, respectively into the second chamber, and through the aperture in the septum to the first aperture in the first chamber which is connected to an external flow path comprising an exhaust duct 60 which carries purified gas from the regenerator beds to be exhausted to the atmosphere. In these cases, the "Outlets to Beds" shown in FIG. 1 become "Inlets from Beds" and the "Inlet" shown in FIG. 1 becomes an "Outlet" either to the exhaust fan or the purge fan.

The purge damper sub-system is also configured identically to the inlet and exhaust purge damper sub-systems and for the embodiment shown in the drawings employing an induced or negative pressure purge the purge damper sub-system employs a flow configuration identical to the exhaust damper sub-system. Gas flow is received from the three regenerators through the second, third or fourth aperture respectively, and exits through the first aperture to a purge recycle duct 62.

The present invention accommodates reduced manufacturing costs for the damper subsystems through the use of flat plate components for the walls and upper and lower sealing plates of the dampers. The cutting of rectangular plate provides straight weldments and avoids the need for casting the damper components in the embodiments shown in the drawings. Flanges for piping attachment are mounted to the plate surfaces at the aperture without the requirement for complex curvature in the welds reducing likelihood of leakage and complex thermal forces in the joints.

Description of the operation of a regenerative thermal oxidizer system employing the damper arrangements of the present invention is best made using FIG. 2. As an initial condition for the operational description, the first regenerator bed acts as the inlet regenerator, the second regenerator bed acts as the outlet regenerator, while the third regenerator bed is idle for purging. Process gas flow enters through the inlet duct reaching the inlet damper sub-system which has its first damper blade configured in the first position, blocking and sealing the aperture in the septum. Process gas flow is therefore directed out of the first chamber through the second aperture and to the first regenerator bed. Gas flows through the first regenerator bed upward, being heated by the regenerative material contained in the bed and is drawn into the combustion chamber 64 which receives supplemental combustion energy through a burner 66 as necessary to further raise the temperature of the process gas sufficiently for oxidation to destroy the hydrocarbon contaminants in the gas. Gas is drawn from the combustion chamber into the second regenerator bed which draws heat from the gas, cooling the gas and heating the regenerative material in the second regenerator. The purified gas is drawn through the outlet of the second regenerator into the third aperture of the exhaust damper sub-system which is configured with the first damper blade in the second position, thereby sealing the second aperture and opening the aperture in the septum, and the second damper blade in the first position sealing the fourth aperture causing the purified gas to flow from the second regenerator bed through the third aperture, through the second chamber and the aperture in the septum to the first chamber, through the first aperture in the body to the exhaust duct 60 where it is drawn through an exhaust fan (not shown) and released to the atmosphere through an exhaust stack or other appropriate means. The embodiment described herein employs the exhaust fan for inducing process gas flow through the regenerator system.

With the first regenerator bed as an inlet and the second regenerator bed as an outlet, the third regenerator bed is idle for purging. The purge damper subassembly is arranged with the first damper blade in the second position, and the second damper blade in the second position, thereby sealing the second and third apertures, respectively, to preclude communication with the first and second regenerator beds. Gas present in the third regenerator bed is drawn by induced flow through the fourth aperture into the second chamber through the aperture in the septum into the first chamber, and through the first aperture into the purge recycle duct by a purge combustion fan 64. The purge combustion fan also draws fresh air through air duct 67 for combination with the purge gas. This combination of purge gas and fresh air is provided as combustion air from the combustion purge fan through inlet duct 68 for combination with supplemental fuel such as propane or natural gas from duct 70 through mixture adjustment valve 72 to the burner. Excess combustion air provided by the purge combustion fan is routed through return duct 74 to the process gas inlet duct. Control of the excess combustion air return is accomplished through dampers 74A and B in the combustion air duct and return duct, respectively.

After a first period which may be determined as an elapsed time or from temperature sensor inputs on the inlet or outlet regenerators, gas flow through the regenerator system is altered by moving the first and second damper blades in the inlet damper sub assembly to the second and first positions, respectively, causing process gas to flow through the first and second chambers to the third aperture and into the second regenerator bed, which now acts as the inlet regenerator. The second damper blade of the exhaust damper sub-system is moved to the second position, thereby closing and sealing the third aperture and opening the fourth aperture causing gas to flow through the third regenerator bed as the outlet regenerator from the combustion chamber. The damper blades of the purge damper sub-assembly are re-positioned with the first damper blade in the first position, thereby exposing the first regenerator bed to the induced purge flow withdrawing any remaining contaminated gas as previously described.

Upon completion of the second period, flow through the system is again altered by the retaining the first damper blade in the inlet damper sub-assembly in the second position and moving the second damper blade to the second position, thereby causing process gas to flow through the first and second chambers to the fourth aperture and into the third regenerator bed, which now acts as the inlet regenerator. The exhaust damper subsystem is simultaneously reconfigured with the first damper blade in the first position, thereby closing and sealing the fifth aperture in the septum and opening the second aperture thereby causing gas to flow through the first regenerator bed as the outlet regenerator from the combustion chamber. Finally, the damper blades of the purge damper sub-assembly are repositioned with the first damper blade in the second position closing the second aperture and opening the fifth aperture in the septum and the second damper blade in the first position, thereby exposing the second regenerator bed to the induced purge flow.

Upon completion of the third period, repositioning of the damper blades in the inlet damper subsystem, exhaust damper subsystem, and purging damper subsystem is accomplished to place the dampers in the initial condition, completing a full operational cycle.

The present invention precludes loss of flow and consequent process flow interruption during reconfiguration of the dampers. As is clear from the description and the drawings, a flowpath continuously remains open during reconfiguration of the damper blades. For example, in the first configuration change described, wherein the inlet regenerator is shifted from the first regenerator bed to the second regenerator bed, motion of the first damper blade from the first position to the second position simultaneously opens the aperture in the septum while closing the second aperture in the body, creating a smooth flow transition from the second aperture through the septum. Similarly, flow reconfigurations between the second and third regenerator beds by repositioning the second damper blade provides simultaneous opening and closing of the apertures to the second and third regenerator beds.

Figure 3:
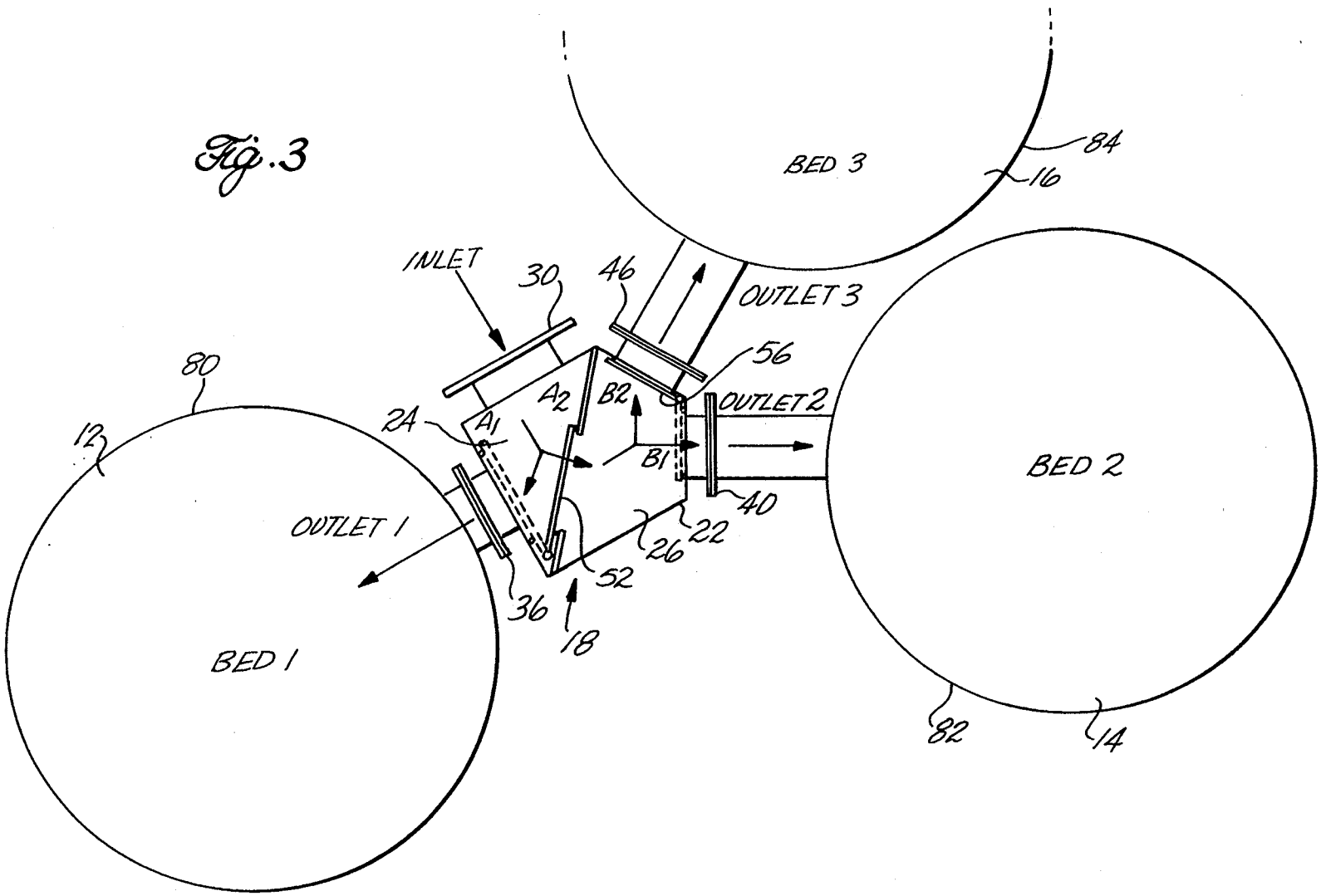
FIG. 3 is a plan view of a second embodiment of the invention employing separate regenerator bed canisters.

A second embodiment of the invention is shown in FIG. 3. This embodiment employs three separate canisters for the regenerators in the thermal oxidizer system. The first regenerator bed 12 is contained in a canister 80, the second regenerator bed 14 is contained in a second separate cannister 82 and the third regenerator bed 16 is contained in a third cannister 84. The embodiment shown provides side entry proximate the bottom of vertical cylindrical cannisters for the conduits communicating from the damper to the regenerator beds. Those skilled in the art will recognize that various flow and process requirements may warrant centralized placement of the conduits for bottom entry into the cannisters or other convenient arrangement.

The present invention lends itself to easy geometrical configuration to accommodate positioning of the canisters in any desired location without complex ducting bends.

Those skilled in the art will recognize that the damper systems of the present invention are equally employable in alternate embodiments wherein, positive pressure flow systems and positive pressure purge arrangements are employed in various combinations. Having now described the invention in detail as required by the patent statutes, substitutions and modifications of the elements of the invention may be made to accommodate specific embodiments or requirements. Such modifications and substitutions are within the scope of the present invention as defined in the following claims.

What is claimed is:

1. A damper for controlling flow in a regenerative thermal oxidizer having three regenerator beds, the damper comprising:

a body having first and second chambers, the first chamber having a first aperture therein for communication with an external flow path and a second aperture therein for communication with a first regenerator bed, the second chamber having a third aperture for communication with a second regenerator bed, and a fourth aperture for communication with a third regenerator bed;

a septum separating the first and second chambers and containing a fifth aperture;

a first damper blade pivotally mounted within the first chamber intermediate the second and fifth apertures;

means for pivoting the first damper blade between a first position sealing the fifth aperture in the septum and a second position covering and sealing the second aperture;

a second damper blade pivotally mounted within the second chamber intermediate the third aperture and fourth aperture; and means for pivoting the second damper blade between a first position covering and sealing the fourth aperture and a second position covering and sealing the third aperture.

2. A damper system as defined in claim 1 wherein the body comprises a first flat plate wall containing the first aperture, a second flat plate wall containing the second aperture, a third flat plate wall containing the third aperture and a fourth plate wall containing the fourth aperture and wherein the first damper blade is pivotally mounted at a vertex formed by the intersection of the septum and second wall, rotation of the first blade on the pivotal mounting providing motion from the first position to the second position and wherein the second damper blade is pivotally mounted at a vertex formed by the intersection of the third and fourth walls wherein rotation of the second damper blade on the pivotal mounting provides motion from the first position to the second position.

3. A damper as defined in claim 1 wherein the first chamber has an external surface on which the first and second apertures reside and the second chamber has an exterior surface carrying the third and fourth apertures, and wherein the first damper blade is pivotally mounted proximate an intersection of the septum and the external surface of the first chamber, rotation of the first blade on the pivotal mounting providing motion from the first position to the second position and wherein the second damper blade is pivotally mounted on the surface of the second chamber intermediate the third and fourth apertures, rotation of the second damper blade on the pivotal mounting providing motion from the first position to the second position.

4. A thermal oxidizer flow control system for controlling flow to three regenerator beds comprising:

an inlet damper having first and second chambers, the first chamber receiving process gas inlet flow and having a communication path with a first regenerator bed and a communication path to the second chamber;

a first damper blade means mounted in the inlet damper for movably positioning in a first position interrupting the communication path between the first chamber and second chamber and a second position interrupting the communication path to the first regenerator bed, the second chamber having a communication path to a second regenerator bed and a communication path to a third regenerator bed;

a second damper blade means mounted in the inlet damper for movably positioning in a first position interrupting the communication path to the third regenerator bed and a second position interrupting the communication path with a second regenerator bed;

an exhaust damper having a body with first and second chambers, the first chamber having a communication path with an exhaust means and further, having a communication path with the first regenerator bed and communication path with the second chamber of the exhaust path, a third damper blade means mounted in the exhaust damper for movably positioning in a first position interrupting the communication path with the second chamber of the exhaust damper and a second position interrupting the communication path to the first regenerator bed, the second chamber of the exhaust damper having a communication path with the second regenerator bed and a communication path with the third regenerator bed;

a third damper blade means for movably positioning in a first position interrupting the communication path with the third regenerator and a second position interrupting the communication path with the second regenerator bed; and control means for positioning the first, second, third and fourth damper blades for communication by the inlet damper valve with the first regenerator bed in combination with communication by the exhaust damper with the second regenerator bed during a first cycle, communication by the inlet damper with the second regenerator bed and the outlet damper with the third regenerator bed in a second cycle and communication through the inlet damper to the third regenerator bed with communication through the exhaust damper to the first regenerator bed in a third cycle.

5. A regenerative thermal oxidizer flow control system as defined in claim 4 further comprising:

a purge damper having a body with first and second chambers, the first chamber communicating with a purge flow means, the first chamber further having a communication path with the first regenerator bed and a communication path with the second chamber, a fifth damper blade means mounted in the purge damper for movably positioning in a first position interrupting the communication path between the first and second chambers of the purge damper and a second position interrupting communication path with the first regenerator bed, the second chamber communicating with the second regenerator bed and communicating with the third regenerator bed;

a sixth damper blade means for movably positioning in a first position interrupting communication path with the third regenerator bed and a second position interrupting communication path with the second regenerator bed; and wherein the control means further controls moving the fifth and sixth damper blades for communication through the purge damper by the third regenerator bed during the first cycle, the first regenerator bed during the second cycle and the second regenerator bed during the third cycle.

6. A damper for controlling flow in a regenerative thermal oxidizer, having three regenerator beds, the damper comprising:

a body having first and second chambers, the first chamber having a first wall with a first aperture therein for communication with an external flow path and a second wall with a second aperture therein for communication with a first regenerator bed, the second chamber having a third wall with a third aperture for communication with a second regenerator bed and a fourth wall with a fourth aperture therein for communication with a third regenerator bed;

a septum intermediate the first and second chambers and containing a fifth aperture;

a first damper blade pivotally mounted at a vertex created by the septum and the second wall;

means for pivoting the first damper blade between a first position covering and sealing the fifth aperture in the septum and a second position covering and sealing the second aperture;

a second damper blade pivotally mounted at a vertex of the third wall in the second chamber and the fourth wall in the second chamber; and means for pivoting the second damper blade between a first position covering and sealing the fourth aperture and a second position covering and sealing the third aperture.

* * * * *

UNITED STATES PATENT AND TRADEMARK OFFICE

CERTIFICATE OF CORRECTION

PATENT NO. : 5,346,393

DATED : September 13, 1994

INVENTOR(S) : Melanius D'Souza

It is certified that error appears in the above-indentified patent and that said Letters Patent is hereby corrected as shown below:

Column 3, line 11, change "FIG 2.)" to -- FIG. 2) --.

Column 4, line 9, after "purge" insert a comma.

Column 5, line 26, change "sub assembly" to -- subassembly --.

Column 5, line 42, before "retaining" delete "the".

Column 7, line 62, change "path" to -- damper --.

Signed and Sealed this

Thirty-first Day of October 1995

*Attest:*

Bruce Lehman

BRUCE LEHMAN

*Attesting Officer*

*Commissioner of Patents and Trademarks*